US005246633A

United States Patent [19]

Teng

[11] Patent Number: 5,246,633

[45] Date of Patent: Sep. 21, 1993

[54] DEVICE FOR COLLECTING USED STEAM

[76] Inventor: Chin-Lin Teng, 2nd Fl., No. 1, Alley 40, Lane 292, Pao-Ping Rd., Yungho City, Taiwan

[21] Appl. No.: 935,441

[22] Filed: Aug. 25, 1992

[51] Int. Cl.[5] ..... B01F 3/04

[52] U.S. Cl. ..... 261/36.1; 261/DIG. 76; 261/DIG. 75; 261/DIG. 32; 261/DIG. 13

[58] Field of Search ..... 261/36.1, DIG. 75, DIG. 76, 261/DIG. 32, DIG. 13

[56] References Cited

U.S. PATENT DOCUMENTS

| | | | |
|---|---|---|---|
| 1,056,044 | 3/1913 | Muchka | 261/DIG. 13 |
| 1,059,899 | 4/1913 | Morison | 261/36.1 |
| 2,176,658 | 10/1939 | Gruman | 261/36.1 |
| 2,328,414 | 8/1943 | Beyer | 261/DIG. 13 |
| 2,808,234 | 10/1957 | Rosenblad | 261/DIG. 13 |
| 3,834,133 | 9/1974 | Bow | 261/36.1 |
| 4,211,733 | 7/1980 | Chang | 261/36.1 |
| 4,444,246 | 4/1984 | Reinsch | 261/DIG. 32 |

FOREIGN PATENT DOCUMENTS

| | | | |
|---|---|---|---|
| 95365 | 4/1921 | Switzerland | 261/DIG. 75 |

*Primary Examiner*—Tim Miles

*Attorney, Agent, or Firm*—Reinhart, Boerner, Van Deuren, Norris & Rieselbach

[57] ABSTRACT

A device for collecting used steam from a steam-power operated apparatus includes a low pressure tank connected to the steam-power operated apparatus and a collecting tank provided downstream of the low pressure tank. The collecting tank has a top and a bottom. A condensate recycling pipe has a first end connected to the bottom and a second end directed toward the top. A suction chamber is provided in the collecting tank adjacent to the top and has a top inlet and a bottom outlet. A nozzle is provided at the top inlet and connected to the second end of the condensate recycling pipe. A pump is connected to the condensate recycling pipe for pumping condensate from the collecting tank into the condensate recycling pipe. A suction pipe has a first end connected to the low pressure tank and a second end connected to the suction chamber adjacent to the nozzle.

7 Claims, 3 Drawing Sheets

DEVICE FOR COLLECTING USED STEAM

BACKGROUND OF THE INVENTION

1. Field of the Invention

This invention relates to a device for collecting used steam, more particularly to an improved device for collecting used steam from a steam-power operated apparatus.

2. Description of the Related Art

Referring to FIG. 1, a conventional device (100) for collecting used steam includes a collecting tank (C) for receiving used steam from a steam-power operated apparatus (not shown) and condensate of the used steam, a pipe connected to a top of the collecting tank (C) having an inlet (C1) connected to the steam-power operated apparatus, a pump (B) connected to a bottom of the collecting tank (C) for pumping condensate in the collecting tank (C) out, and a motor (A) connected to the pump (B) for driving the same. The used steam from the steam-power operated apparatus flows into the collecting tank (C) due to the height difference or pressure difference therebetween. Generally, the pressure in the collecting tank (C) gradually increases, and the pressure difference is gradually decreased, thereby prohibiting the flowing of the used steam into the collecting tank (C). Thus, the recovery efficiency of the used steam by such a conventional device (100) is low.

SUMMARY OF THE INVENTION

Therefore, the objective of this invention is to provide an improved device for collecting used steam. The improved device provides a high recovery efficiency for the used steam.

Accordingly, a device for collecting used steam from a steam-power operated apparatus and the like includes a low pressure tank connected to the steam-power operated apparatus for receiving the used steam and a collecting tank for receiving the used steam from the low pressure tank and condensate of the used steam provided downstream of the low pressure tank, the collecting tank having a top and a bottom. A condensate recycling pipe has a first end connected to the collecting tank adjacent to the bottom and a second end directed toward the top. A suction chamber is provided in the collecting tank adjacent to the top and has a top inlet and a bottom outlet. A nozzle is provided at the top inlet and is connected to the second end of the condensate recycling pipe in order to inject the recycled condensate through the suction chamber. A pump is connected to the condensate recycling pipe for pumping the condensate from the collecting tank into the condensate recycling pipe. A suction pipe has a first end connected to the low pressure tank and a second end connected to the suction chamber adjacent to the nozzle. The used steam in the low pressure tank is suctioned by being entrained by the injected recycled condensate, a vacuum is created in the low pressure tank, and the flow of the used steam is accelerated.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Figure 2:
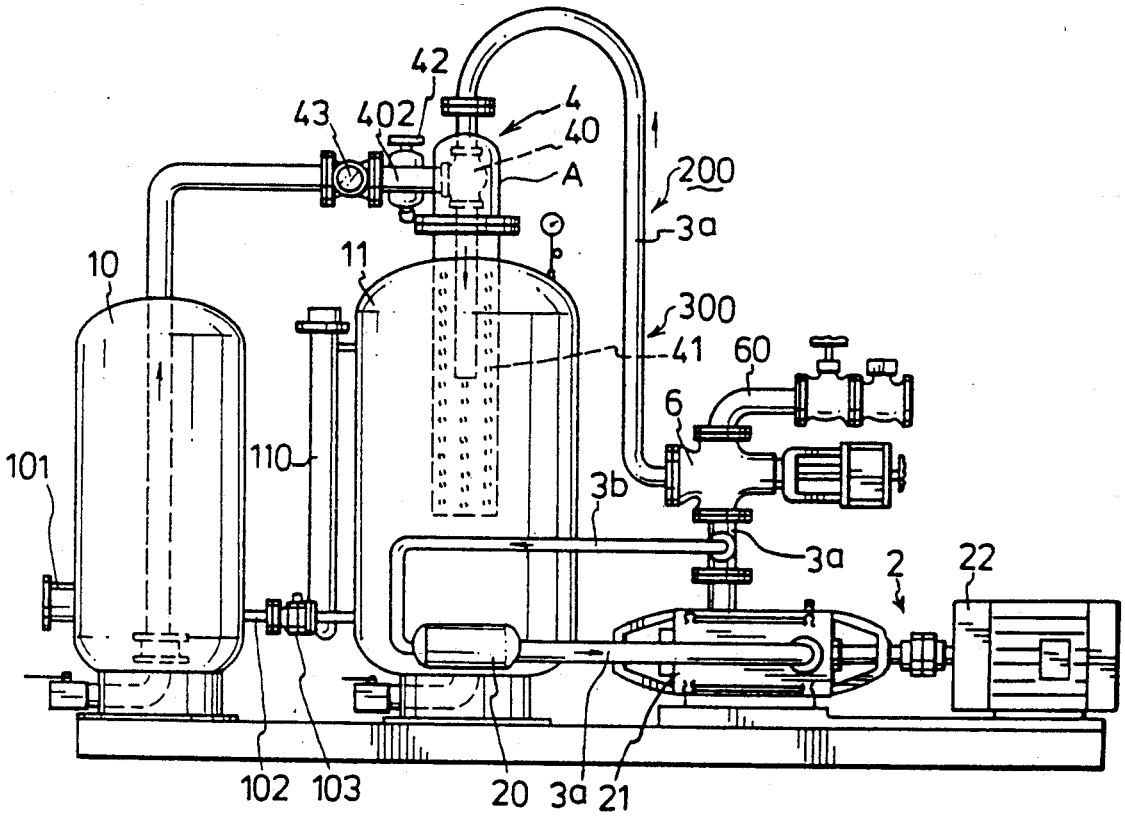
FIG. 2 is a schematic diagram of a device of this invention for collecting used steam.
Figure 3:
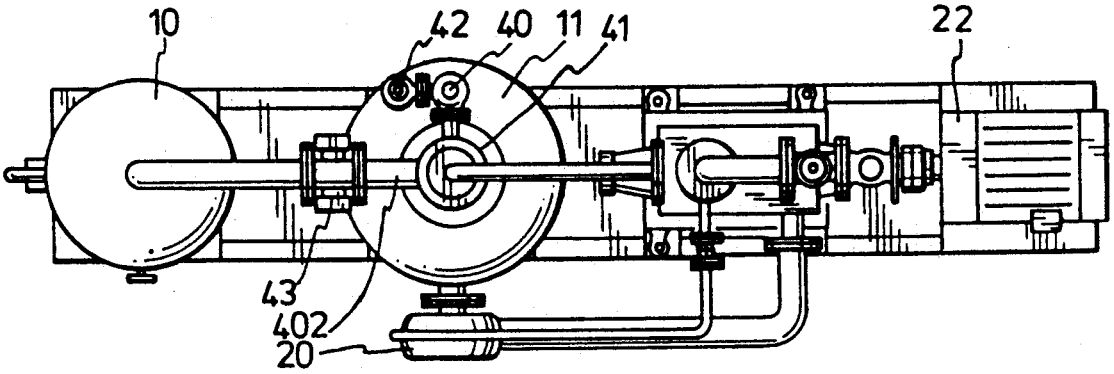
FIG. 3 is a top view of the device of this invention for collecting used steam.
Figure 4:
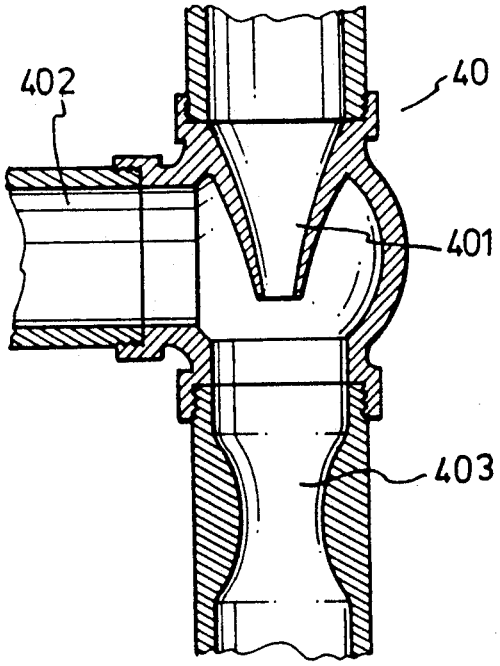
FIG. 4 is a sectional view of a suction chamber of the device of this invention.

Referring to FIGS. 2 to 4, a device (200) of this invention for collecting used steam from a steam-power operated apparatus (not shown) includes a low pressure tank (10), which is used for receiving the used steam therein and has an inlet (101) connected to the steam-power operated apparatus, and a collecting tank (11) for receiving the used steam from the low pressure tank (10) and condensate of the used steam. The collecting tank (11) is provided downstream of the low pressure tank (10) and has a top, a bottom and a liquid level controlling member (110) mounted thereon to detect the liquid level of the condensate. A pipe (102) is connected to the low pressure tank (10) and the collecting tank (11) adjacent to the bottom thereof. A valve (103) is mounted on the pipe (102). A condensate recycling unit (300) includes a first condensate recycling pipe (3*a*) having a first end connected to the bottom of the collecting tank (11) and a second end directed toward the top of the collecting tank (11), an injector (20) communicating the interior of the collecting tank (11) and connected to the first end of the first condensate recycling pipe (3*a*), a pump (21) connected to the first condensate recycling unit (3*a*) downstream of the injector (20) and a motor (22) connected to the pump (21). A second condensate recycling pipe (3*b*) is connected to the first condensate recycling pipe (3*a*) and the injector (20). An electromagnetic valve (6) is mounted on the first condensate recycling pipe (3*a*) downstream from the second condensate recycling pipe (3*b*) and connected to the liquid level controlling member (110). A condensate discharging conduit (60) is connected to the electromagnetic valve (6). The collecting tank (11) includes a cylindrical housing (A) connected to the top thereof. A suction chamber (40) is provided in the cylindrical housing (A) and extends into the collecting tank (11). The suction chamber (40) has a top inlet, a bottom outlet, a nozzle (401) provided at the top inlet and connected to the second end of the first condensate recycling pipe (3*a*), and a venturi section (403) provided below the nozzle (401). The nozzle (401) and the venturi section (403) cooperate to inject the recycled condensate through the suction chamber (40). A perforated buffer (41) is connected to the cylindrical housing (A) and provided around the suction chamber (40) adjacent to the bottom outlet of the suction chamber (40) in order to decrease the flow rate of the injected recycled condensate. A relief valve (42) is provided adjacent to the top of the collecting tank (11) and is connected to the suction chamber (40). A suction pipe (402) has a first end connected to the low pressure tank (10) and a second end connected to the suction chamber (40) adjacent to the nozzle (401). A viewing window (43) is mounted on the suction pipe (402).

Figure 1:
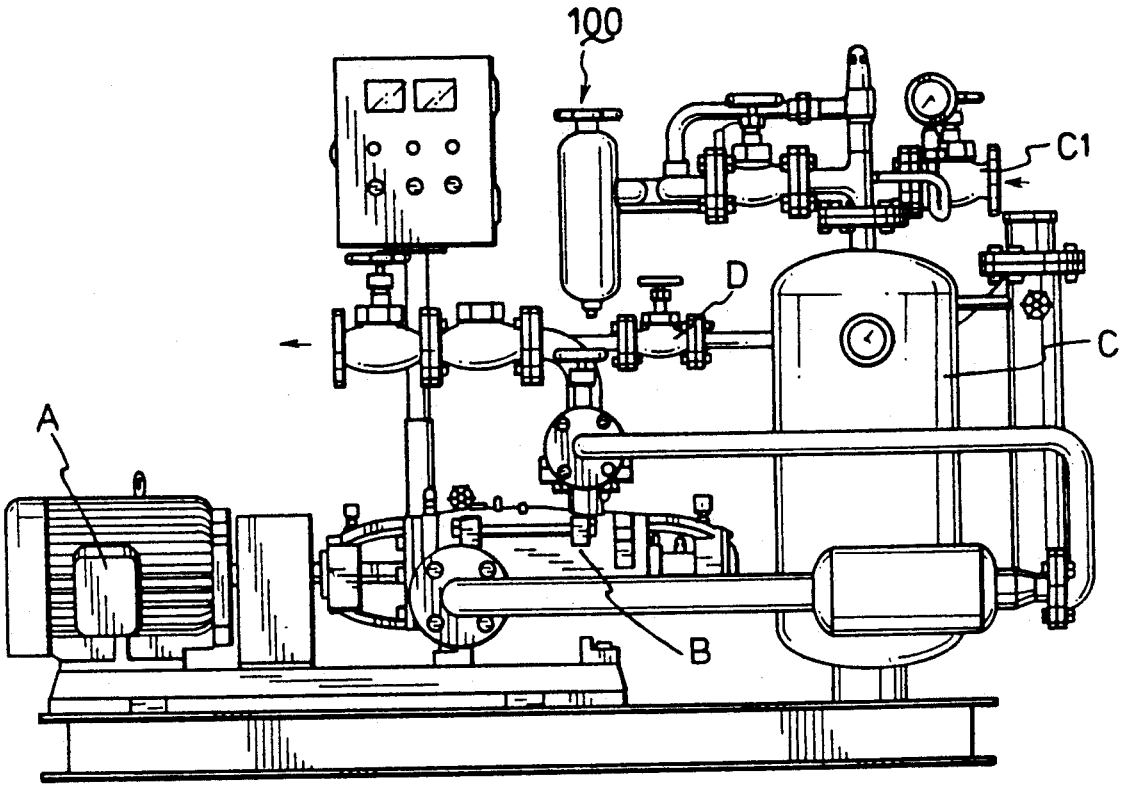
FIG.1 PRIOR ART
FIG. 1 is a schematic diagram of a conventional device for collecting used steam.

At the beginning, used steam from the steam-power operated apparatus flows into the low pressure tank (10). The valve (103) is opened, and the used steam in the low pressure tank (10) flows into the collecting tank (11) through the pipe (102). The used steam in the collecting tank (11) condenses to condensate. When the condensate in the collecting tank (11) reaches a predetermined liquid level, the valve (103) is closed to prevent the used steam from entering into the collecting tank (11) through the pipe (102), and the pump (21) which is driven by the motor (2) begins to operate. Condensate in the collecting tank (11) is pumped and recycled through the first condensate recycling pipe (3*a*). Since the condensate has a high temperature, the condensate will entrain vapor, thereby causing a discontinuous condensate flow during the pumping operation. Therefore, the injector (20) containing a nozzle (not shown) is provided, and a portion of the condensate in the first condensate recycling pipe (3*a*) is recycled through the second condensate recycling pipe (3*b*) and the injector (20) so as to speed up the flow of the condensate from the collecting tank (11) into the first condensate recycling pipe (3*a*). The used steam in the low pressure tank (10) from the steam-power operated apparatus is suctioned into the collecting tank (11) through the suction pipe (402) by being entrained by the injected recycled condensate. A vacuum is created in the low pressure tank (10), and the flow of the used steam is accelerated. The liquid level controlling member (110) actuates the electromagnetic valve (6) to conduct the condensate from the first end of the first condensate recycling pipe (3*a*) into the condensate discharge conduit (60) instead of into the second end of the first condensate recycling pipe (3*a*) when condensate in the collecting tank (11) reaches a predetermined high liquid level. At this stage, the flow of the used steam is not accelerated. The liquid level controlling member (110) actuates the electromagnetic valve (6) to conduct the condensate from the first end of the first condensate recycling pipe (3*a*) into the second end of the first condensate recycling pipe (3*a*), and the flow of the used steam is accelerated again when condensate in the collecting tank (11) reaches a predetermined low liquid level. In addition, vapor in the collecting tank (11) can be discharged through the relief valve (42) when the gas pressure in the collecting tank (11) is excessive. The used steam from the steam-operated apparatus is continuously collected by the above described process. Therefore, the device (200) of this invention has a higher recovery efficiency for the used steam than that of the conventional device (100) in FIG. 1.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A device for collecting used steam from a steam-power operated apparatus and the like comprising:

a low pressure tank connected to said steam-power operated apparatus for receiving said used steam;

a collecting tank for receiving said used steam from said low pressure tank and condensate of said used steam provided downstream of said low pressure tank, said collecting tank having a top and a bottom;

a condensate recycling pipe having a first end connected to said collecting tank adjacent to said bottom and a second end directed toward said top;

a suction chamber provided in said collecting tank adjacent to said top and having a top inlet and a bottom outlet, a nozzle provided at said top inlet and connected to said second end of said condensate recycling pipe in order to inject the recycled condensate through said suction chamber;

a pump connected to said condensate recycling pipe for pumping said condensate from said collecting tank into said condensate recycling pipe;

a suction pipe having a first end connected to said low pressure tank and a second end connected to said suction chamber adjacent to said nozzle;

whereby said used steam in said low pressure tank is suctioned by being entrained by the injected recycled condensate, a vacuum is created in said low pressure tank, and the flow of said used steam is accelerated.

2. A device for collecting used steam as claimed in claim 1, wherein said collecting tank has a relief valve provided thereon adjacent to said top of said collecting tank.

3. A device for collecting used steam as claimed in claim 1, further comprising a perforated buffer provided adjacent to said bottom outlet of said suction chamber so as to decrease the flow rate of said injected recycled condensate.

4. A device for collecting used steam as claimed in claim 1, wherein said collecting tank includes a liquid level controlling member mounted thereon.

5. A device for collecting used steam as claimed in claim 4, further comprising an electromagnetic valve, which is connected to said condensate recycling pipe downstream of said pump and said liquid level controlling member, and a condensate discharge conduit connected to said electromagnetic valve.

6. A device for collecting used steam as claimed in claim 1, further comprising an injector connected to said condensate recycling pipe upstream of said pump.

7. A device for collecting used steam as claimed in claim 1, wherein said suction chamber further includes a venturi section provided below said nozzle.

* * * * *